US011349246B2

(12) United States Patent
Zhao

(10) Patent No.: US 11,349,246 B2
(45) Date of Patent: May 31, 2022

(54) METHOD OF MAKING AN ELECTRICAL CONNECTOR BY HOLDING CARRIER STRIPS AGAINST EACH OTHER FOR OVER-MOLDING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 218 days.

(21) Appl. No.: 16/667,933

(22) Filed: Oct. 30, 2019

(65) Prior Publication Data

US 2020/0136293 A1 Apr. 30, 2020

(30) Foreign Application Priority Data

Oct. 30, 2018 (CN) ..... 201811278803.8

(51) Int. Cl.
*H01R 13/405* (2006.01)
*H01R 43/24* (2006.01)
(Continued)

(52) U.S. Cl.
CPC ..... *H01R 13/405* (2013.01); *H01R 13/504* (2013.01); *H01R 13/6585* (2013.01); *H01R 43/16* (2013.01); *H01R 43/24* (2013.01)

(58) Field of Classification Search
CPC ..... H01R 13/405; H01R 13/6585; H01R 13/504; H01R 13/02; H01R 43/24;
(Continued)

(56) References Cited

U.S. PATENT DOCUMENTS 6,004,160 A * 12/1999 Korsunsky ..... H01R 13/26 439/660
7,578,700 B2 * 8/2009 Xiong ..... H01R 13/6477 439/607.01
(Continued)

FOREIGN PATENT DOCUMENTS

CN 206211129 U 5/2017
CN 206271920 U 6/2017
(Continued)

*Primary Examiner* — Donghai D Nguyen
(74) *Attorney, Agent, or Firm* — Ming Chieh Chang; Wei Te Chung

(57) ABSTRACT

A method of making an electrical connector which includes an insulative housing having a tongue and a first and second rows of contacts with respective contacting portions exposed to the two opposite surfaces of the tongue and respective soldering portions is characterized by the steps of: forming the first row of contacts from a first contact carrier to have the soldering portions thereof connected to a first carrier strip; forming the second row of contacts from a second contact carrier to have the soldering portions thereof connected to a second carrier strip; insert-molding the first row of contacts with a first insulator to form a first contact module unit; insert-molding the second row of contacts with a second insulator to form a second contact module unit; holding the first carrier strip and the second carrier strip against each other for further over-molding to form the complete contact module.

14 Claims, 12 Drawing Sheets

(51) Int. Cl.
*H01R 13/6585* (2011.01)
*H01R 13/504* (2006.01)
*H01R 43/16* (2006.01)

(58) Field of Classification Search
CPC .... H01R 43/16; H01R 2107/00; H01R 24/60; Y10T 29/49121; Y10T 29/49222
USPC ..... 29/825, 827, 884
See application file for complete search history.

(56) References Cited

U.S. PATENT DOCUMENTS

| | | | | |
|---|---|---|---|---|
| 9,153,920 | B2 * | 10/2015 | Kamei ..... | H01R 13/655 |
| 9,960,543 | B2 * | 5/2018 | Chen ..... | H01R 43/16 |

FOREIGN PATENT DOCUMENTS

| | | | |
|---|---|---|---|
| CN | 107293876 | A | 10/2017 |
| CN | 206558751 | U | 10/2017 |
| CN | 107546536 | A | 1/2018 |
| CN | 105406241 | B | 2/2019 |
| TW | M533349 | U | 12/2016 |

* cited by examiner

METHOD OF MAKING AN ELECTRICAL CONNECTOR BY HOLDING CARRIER STRIPS AGAINST EACH OTHER FOR OVER-MOLDING

BACKGROUND OF THE INVENTION

1. Field of the Invention

The present invention relates to an electrical connector including a first and second contact module units over-molded, during manufacturing, subsequent to holding respective carrier strips against each other, which obviates a need to secure the first and second contact module units together for the over-molding operation.

2. Description of Related Arts

China Patent No. 107546536 discloses an electrical connector including upper and lower contact module units with respective outermost ground contacts equipped with engaging sections to secure the upper and lower contact module units together ready for subsequent over-molding operation. China Patent No. 206558751 similarly discloses an electrical connector including upper and lower contact module units with respective outermost ground contacts equipped with ears soldered to secure the upper and lower contact module units together before a subsequent over-molding operation.

SUMMARY OF THE INVENTION

A method of making an electrical connector which includes an insulative housing having a tongue with two opposite surfaces and a first and second rows of contacts with respective contacting portions exposed to the two opposite surfaces of the tongue and respective soldering portions is characterized by the steps of: forming the first row of contacts from a first contact carrier to have the soldering portions thereof connected to a first carrier strip; forming the second row of contacts from a second contact carrier to have the soldering portions thereof connected to a second carrier strip; insert-molding the first row of contacts with a first insulator to form a first contact module unit; insert-molding the second row of contacts with a second insulator to form a second contact module unit; holding the first carrier strip and the second carrier strip against each other; and over-molding a third insulator with the first contact module unit and the second contact module unit.

DETAILED DESCRIPTION OF THE PREFERRED EMBODIMENT

Figure 1:
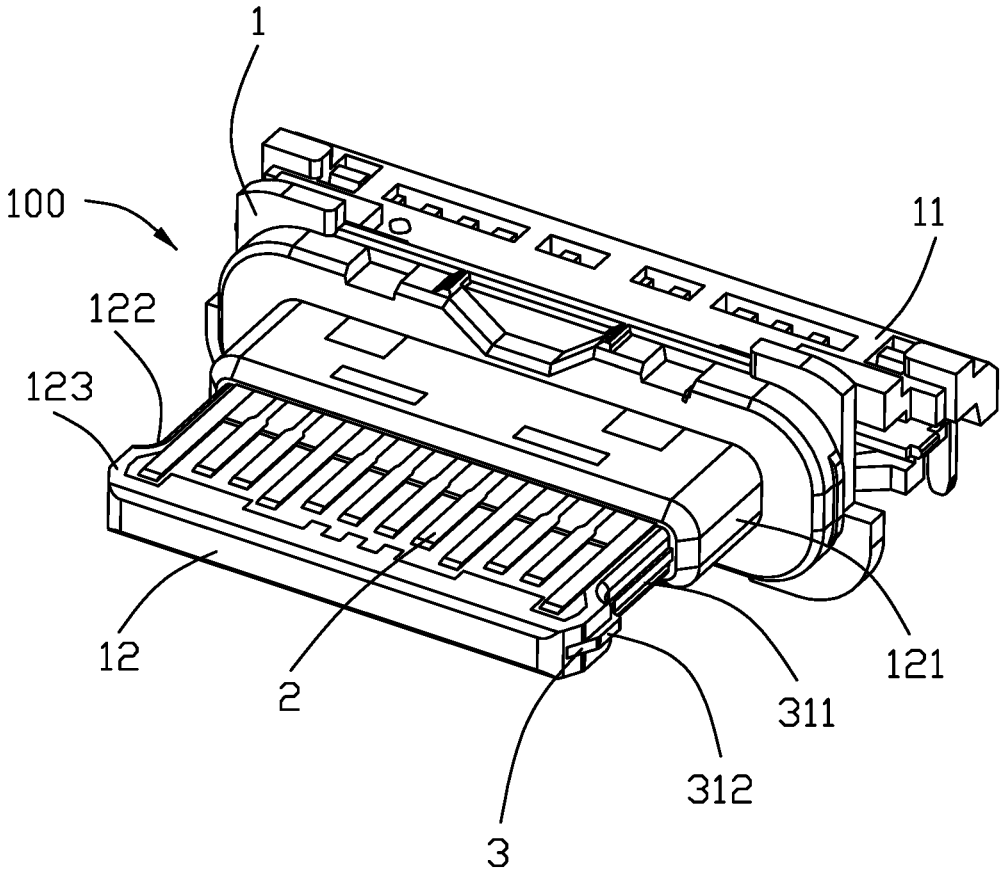
FIG. 1 is a top perspective view of an electrical connector in accordance with the present invention.
Figure 2:
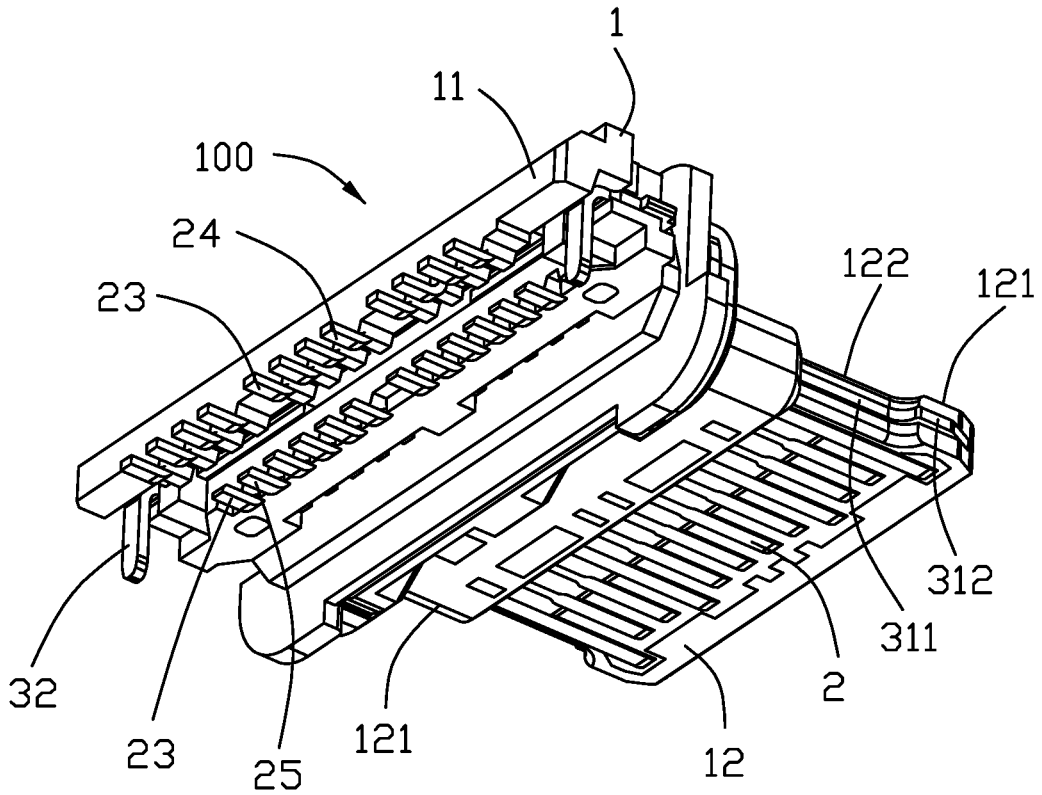
FIG. 2 is a bottom perspective view of the electrical connector.
Figure 3:
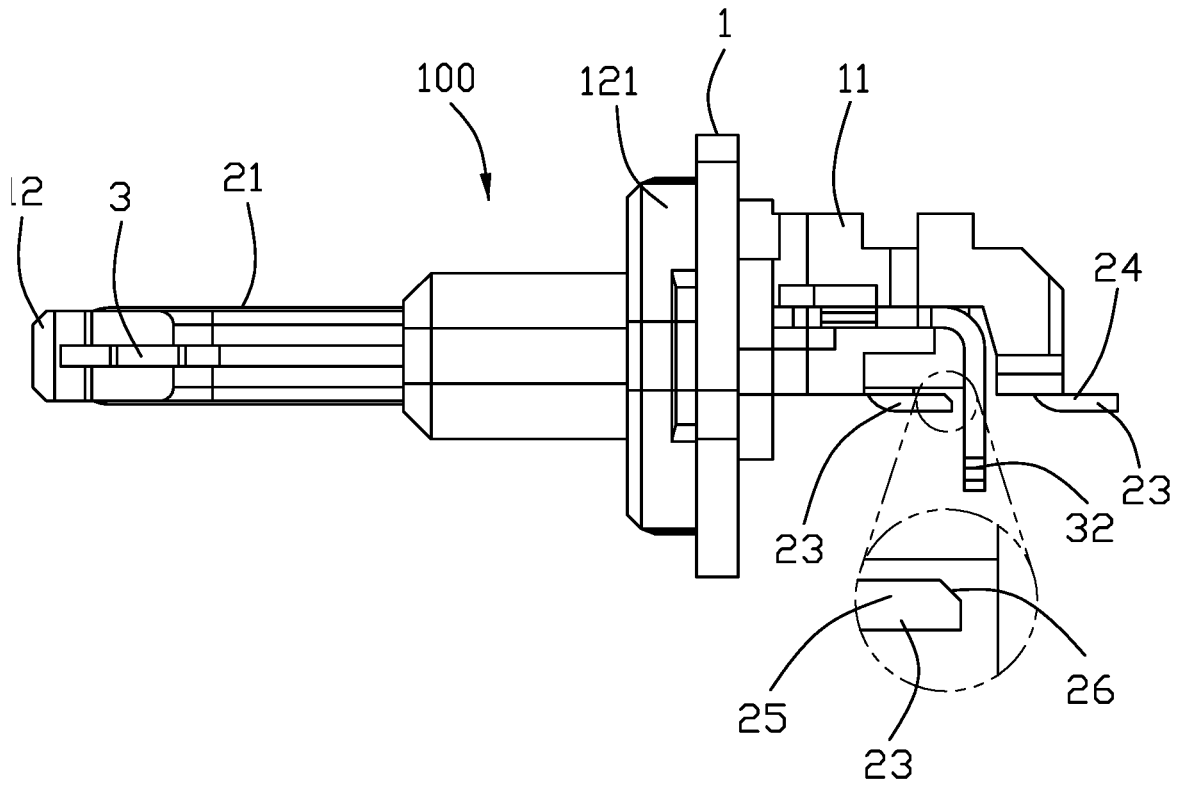
FIG. 3 is a side view of the electrical connector.
Figure 4:
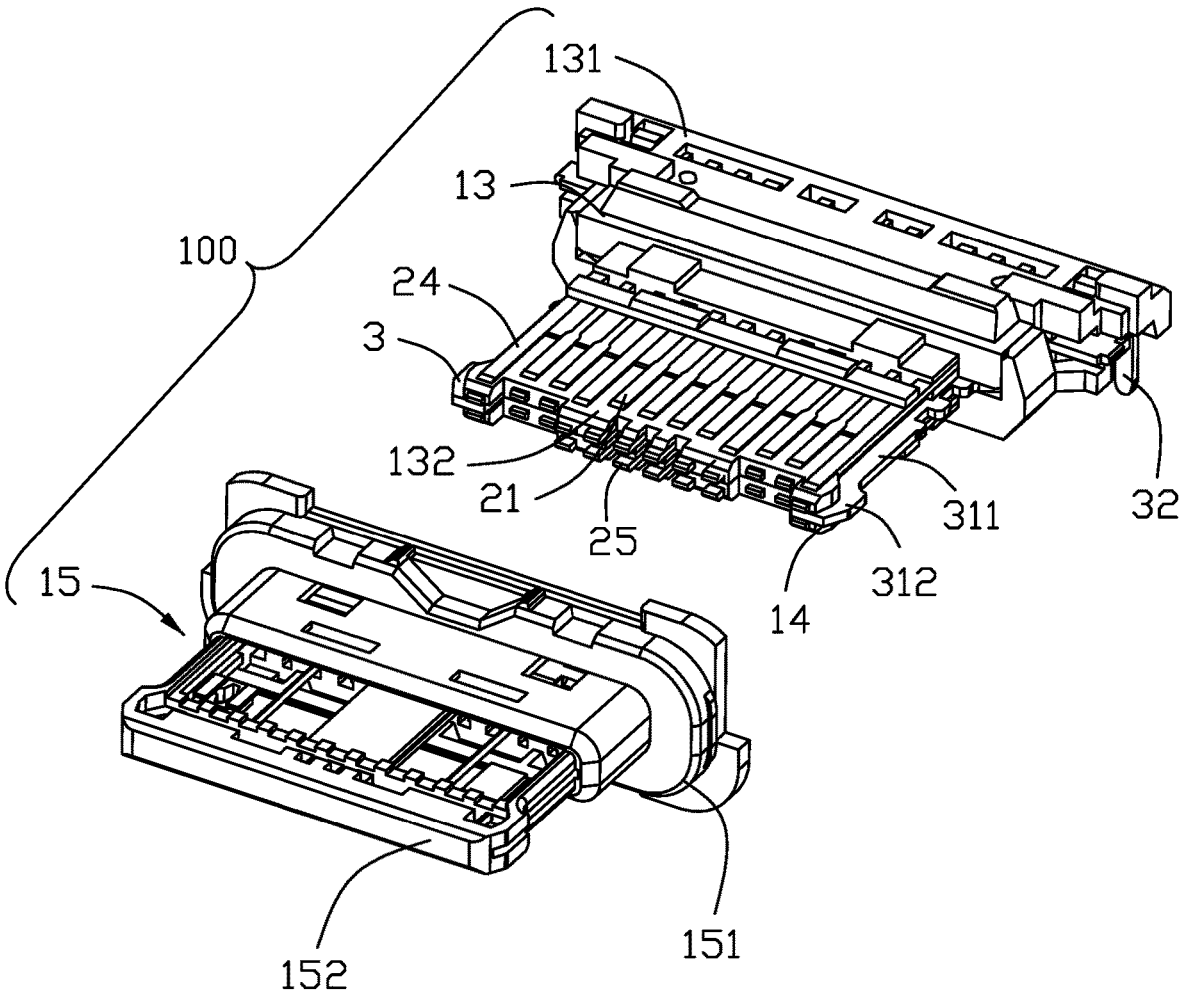
FIG. 4 is an exploded view of the electrical connector in FIG. 1.
Figure 5:
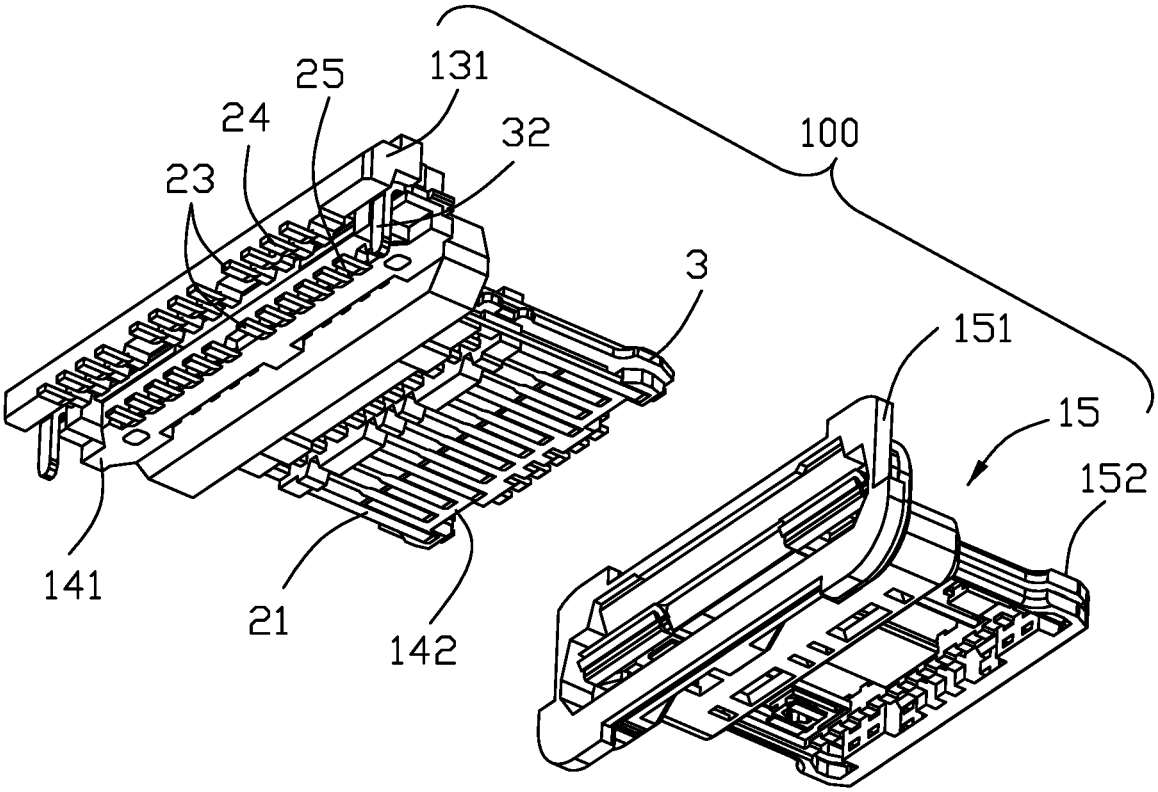
FIG. 5 is an exploded view of the electrical connector in FIG. 2.

Referring to FIGS. 1-12, an electrical connector in accordance with the present invention comprises a contact module 100. The electrical connector may further comprise a shielding shell (not shown) for enclosing the contact module 100. The contact module 100 includes an insulative housing 1 and two rows of contacts 2 secured to the insulative housing 1. The contact module 100 may further include a middle shielding plate 3.

The insulative housing 1 has a base 11 and a frontal tongue 12. The tongue 12 has a step 121, a pair of side notches 122, and a pair of protrusions 123 bordering the notches 122.

The insulative housing 1 includes a first insulator 13, a second insulator 14, and a third insulator 15 to be over-molded to the first and second insulators 13 and 14. The first insulator 13 has a base portion 131 and a tongue portion 132; the second insulator 14 has a base portion 141 and a tongue portion 142; the third insulator 15 has a base portion 151 and a tongue portion 152. The base portions 131, 141, 151 constitute the base 11; the tongue portion 132, 142, 152 constitute the tongue 12.

The contacts 2 are arranged as an upper row of contacts 24 and a lower row of contacts 25 with contact portions thereof arranged centrally-symmetrically to support dual-orientation mating as is well known in this art.

Each contact 2 has a securing portion 22, a front connecting/contacting portion 21 exposing to a corresponding mating surface of the tongue 12, and a rear soldering portion 23. Respective front ends of the contacts 2 are bent to form heads to be embedded in the tongue 12. The soldering portions 23 of the lower row of contacts 25 are aligned in a front line and the soldering portions 23 of the upper row of contacts 24 are aligned in a rear line. All soldering portions 23 of the upper and lower row of contacts 24 and 25 lie on a common plane while offsetting. Each soldering portion 23 of the lower row of contacts 25 has an inclined face 26 due to a configuration of the corresponding V-shaped cut 6 illustrated later.

The shielding plate 3 is constructed as two separate pieces each including a main part 31 and a soldering leg 32. The main part 31 has a pair of notches 311 and a pair of protrusions 312.

To make the contact module 100 of the electrical connector, the method may include primarily: a step of forming the upper row of contacts 24 from a first contact carrier 4 to have the soldering portions 23 thereof connected to a first carrier strip 41 through respective connecting sections 42; a step of forming the lower row of contacts 25 from a second contact carrier 5 to have the soldering portions 23 thereof connected to a second carrier strip 51 through respective connecting sections 52 having bends 7, with respective V-shaped cuts 6 formed between the soldering portions 23 and the connecting sections 52, and with the V-shaped cuts 6 later, after severing, becoming the inclined faces 26; a step of insert-molding the upper row of contacts 24 with the first insulator 13 to form an upper contact module unit 101 and a step of insert-molding the lower row of contacts 25 with the second insulator 14 to form a lower contact module unit 102, with the heads of the contacts 2 exposed; a step of holding the first carrier strip 41 and the second carrier strip 51 against each other by external molding tool or tools; and a step of over-molding the third insulator 15 with the upper contact module unit 101 and the lower contact module unit 102. The second carrier strip 51 may then be conveniently bent to break from the lower row of contacts 25 due to the V-shaped cuts 6. As is well known in this art, a shielding shell may subsequently be assembled and the first carrier strip 41 severed in any desired manner.

With the provision of the bends 7 on the connecting sections 52 of the lower row of contacts 25, it is allowed to position the second carrier strip 51 immediately and intimately below the first carrier strip 41 without interference therebetween for subsequent operation by external molding tool. Understandably, the traditional connector requires to have the upper contact module unit and the lower contact module unit have the corresponding structures secured to each other on rear portions for the over-molding process. It is because that the rear carrier strips of both the upper contact module unit and the lower contact module unit are already requisitely removed therefrom before the over-molding process. The reason why it is required to remove the rear carrier strips of both the upper contact module unit and the lower contact module unit is that the soldering portions of the upper contact module unit and those of the lower contact module unit are located in the same plane, and the associated carrier strips of those two contact module units may interfere with each other when those two contact module units are stacked with each other for over-molding.

In the instant invention, because of the bends 7 on the lower row of contacts 25, the second carrier strip 51 can be offset from the first carrier strip 41 without interference therebetween. Therefore, in the instant invention, it is allowed to keep both the first carrier strip 41 and the second carrier strip 51 during the over-molding process so as to have a fixture secure both the upper contact module unit 101 and the lower contact module unit 102 via both the first carrier strip 41 and the second carrier strip 51 during the over-molding process.

It is also noted that as mentioned earlier in the traditional connector, the first carrier strip and the second carrier strip are removed from the corresponding upper contact module unit and lower contact module unit before the upper contact module unit and the lower contact module unit are stacked together for over-molding. In such a situation, because the soldering portions are rearwardly exposed to an exterior, it is easy to sever the corresponding carrier strip therefrom via a cutter. Anyhow, in the instant invention, after over-molding, the soldering portions 23 of the lower row of contacts 25 are downwardly covered by the housing, thus prohibiting the cutter from approaching. Therefore, in the instant invention, it is required to form the V-shaped cut 6 between the rear end of the soldering portion 23 and the connecting section 52 of the second carrier strip 51 so as to sever the corresponding connecting sections 52 of the second carrier strip 51 from the soldering portions 23 of the lower row of contacts 25 via bending.

Figure 6:
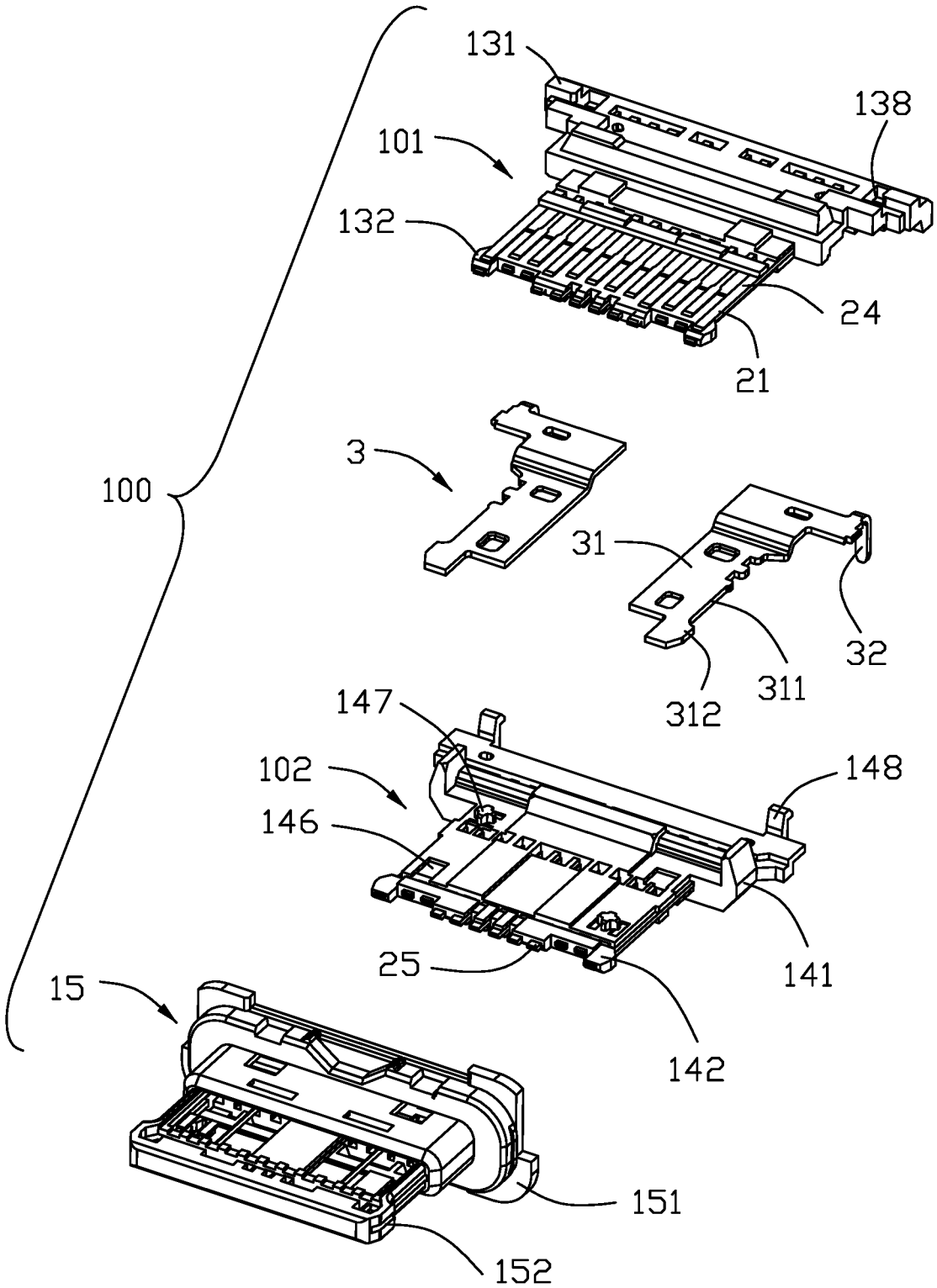
FIG. 6 is a further exploded view of the electrical connector in FIG. 4.
Figure 7:
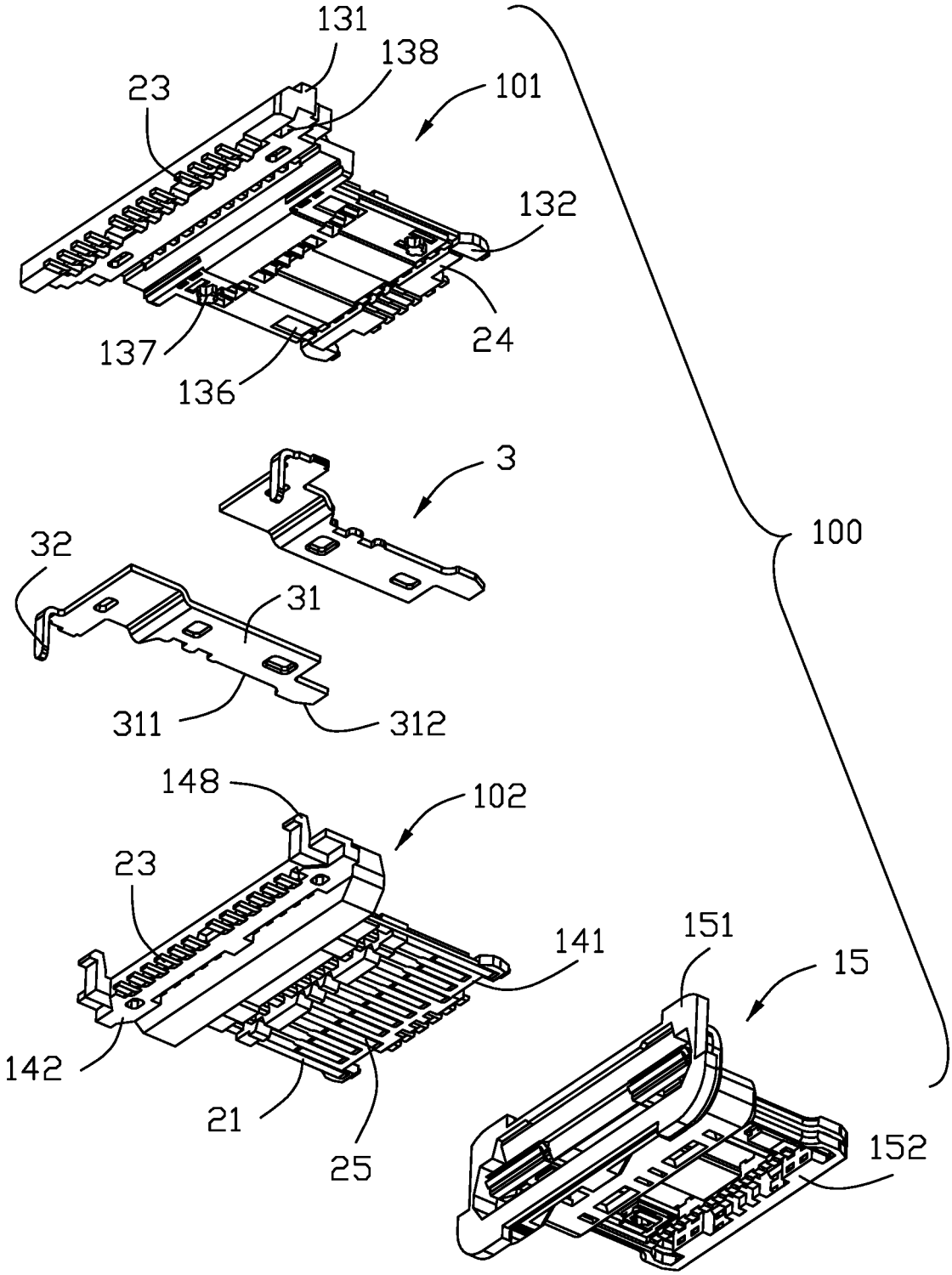
FIG. 7 is a further exploded view of the electrical connector in FIG. 5.
Figure 8:
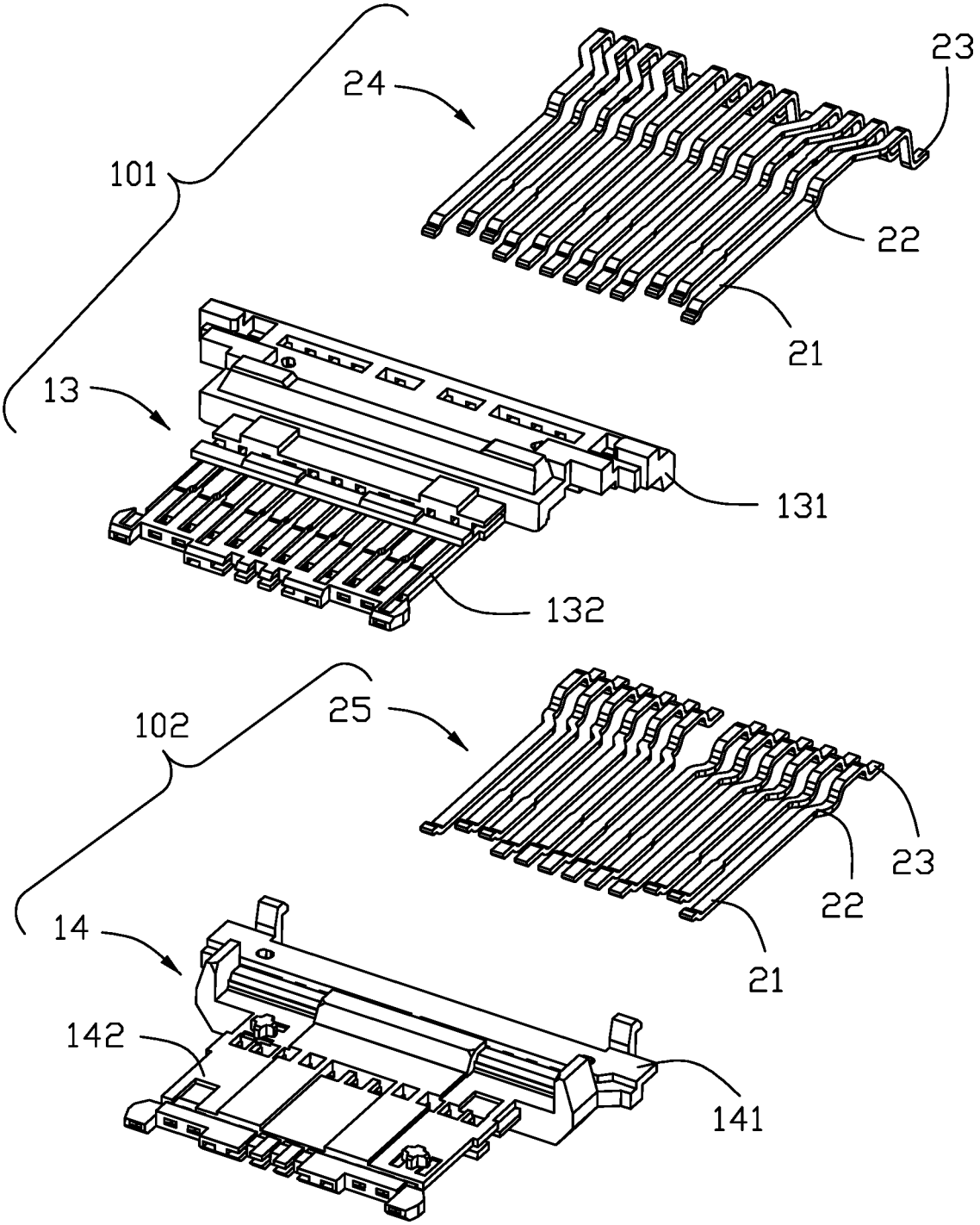
FIG. 8 is an exploded view of a first and a second contact module units of the electrical connector.
Figure 9:
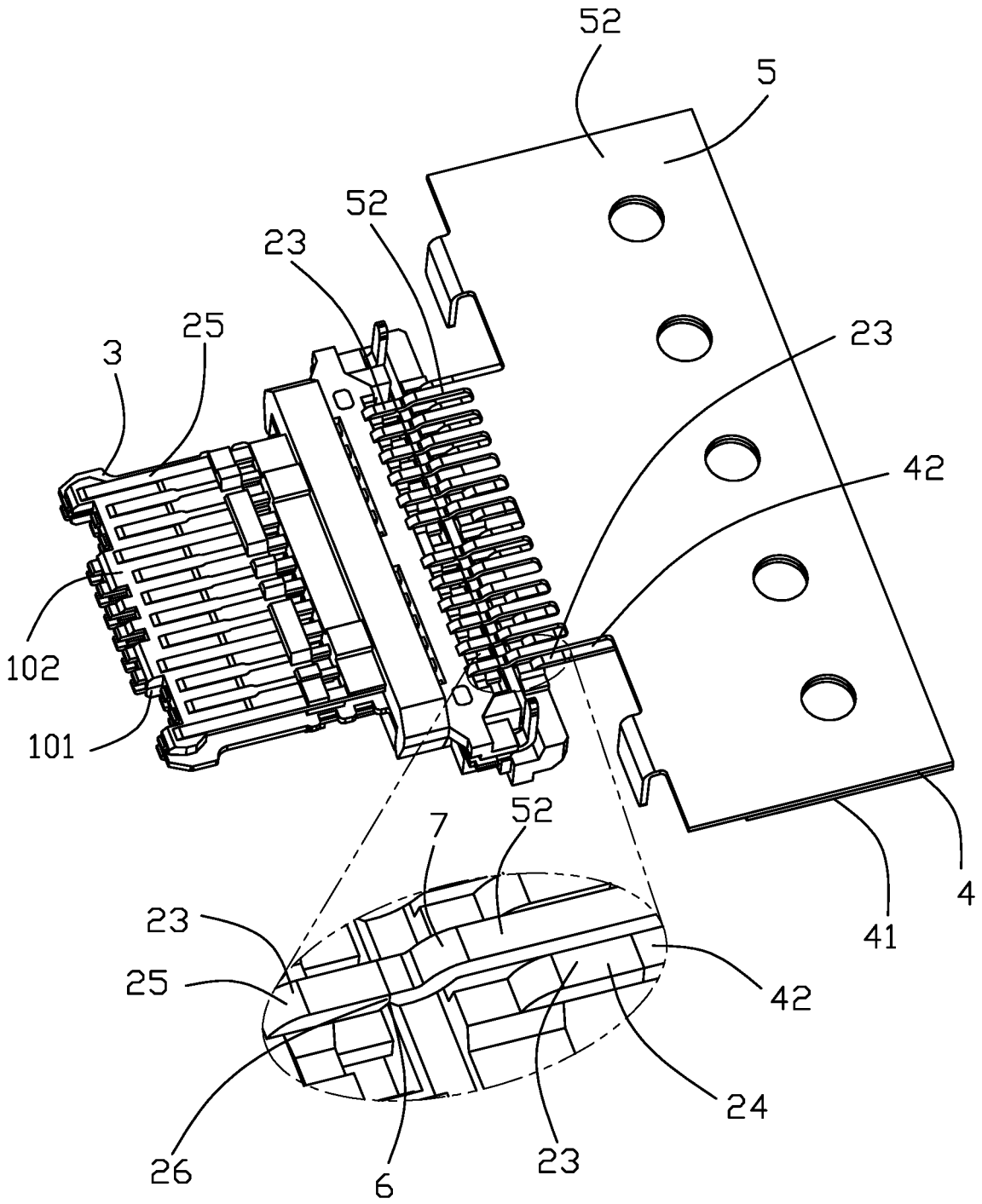
FIG. 9 shows stacked first and second carrier strips connected with the first and second contact module units.
Figure 10:
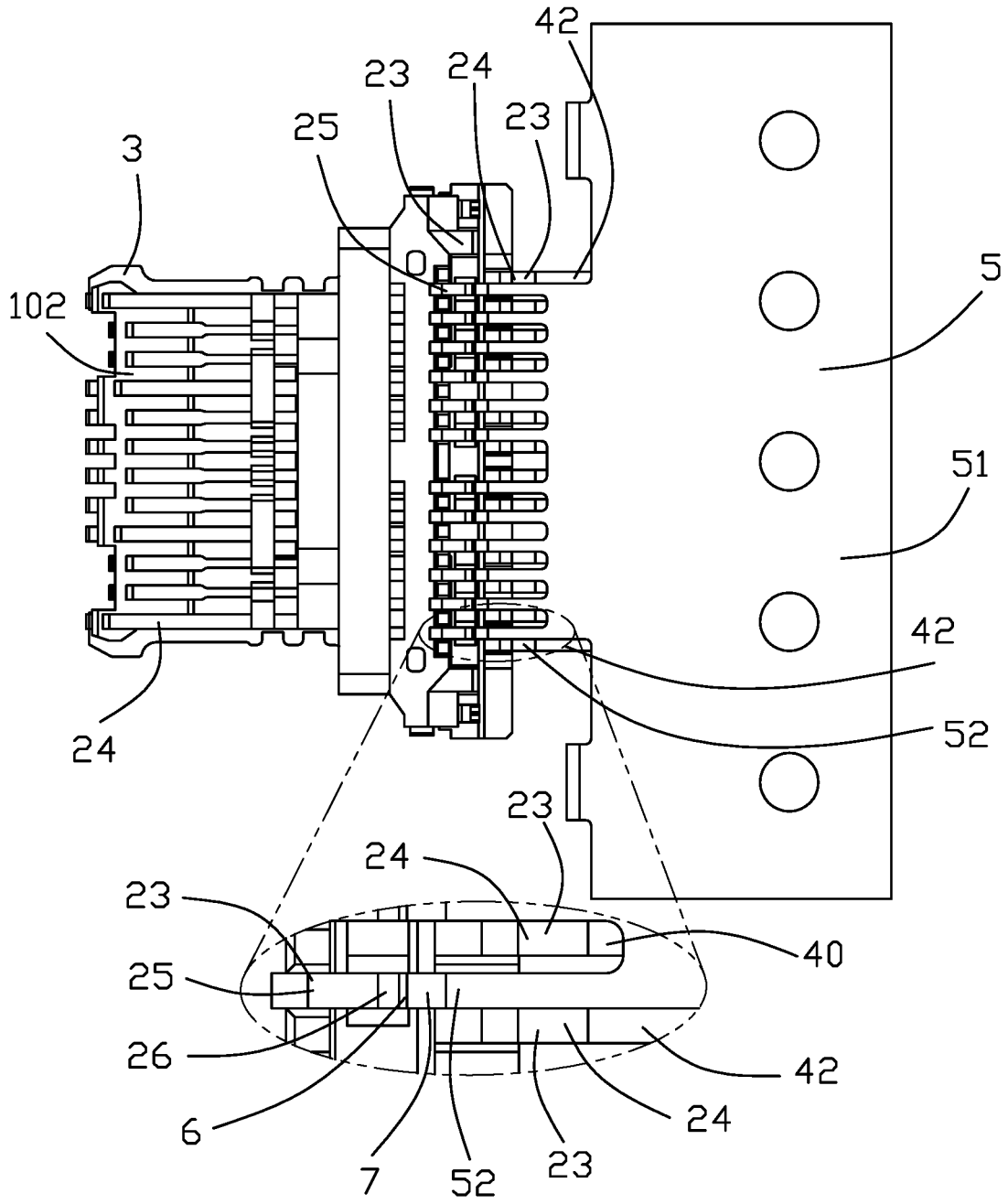
FIG. 10 is a bottom plan view of FIG. 9.
Figure 11:
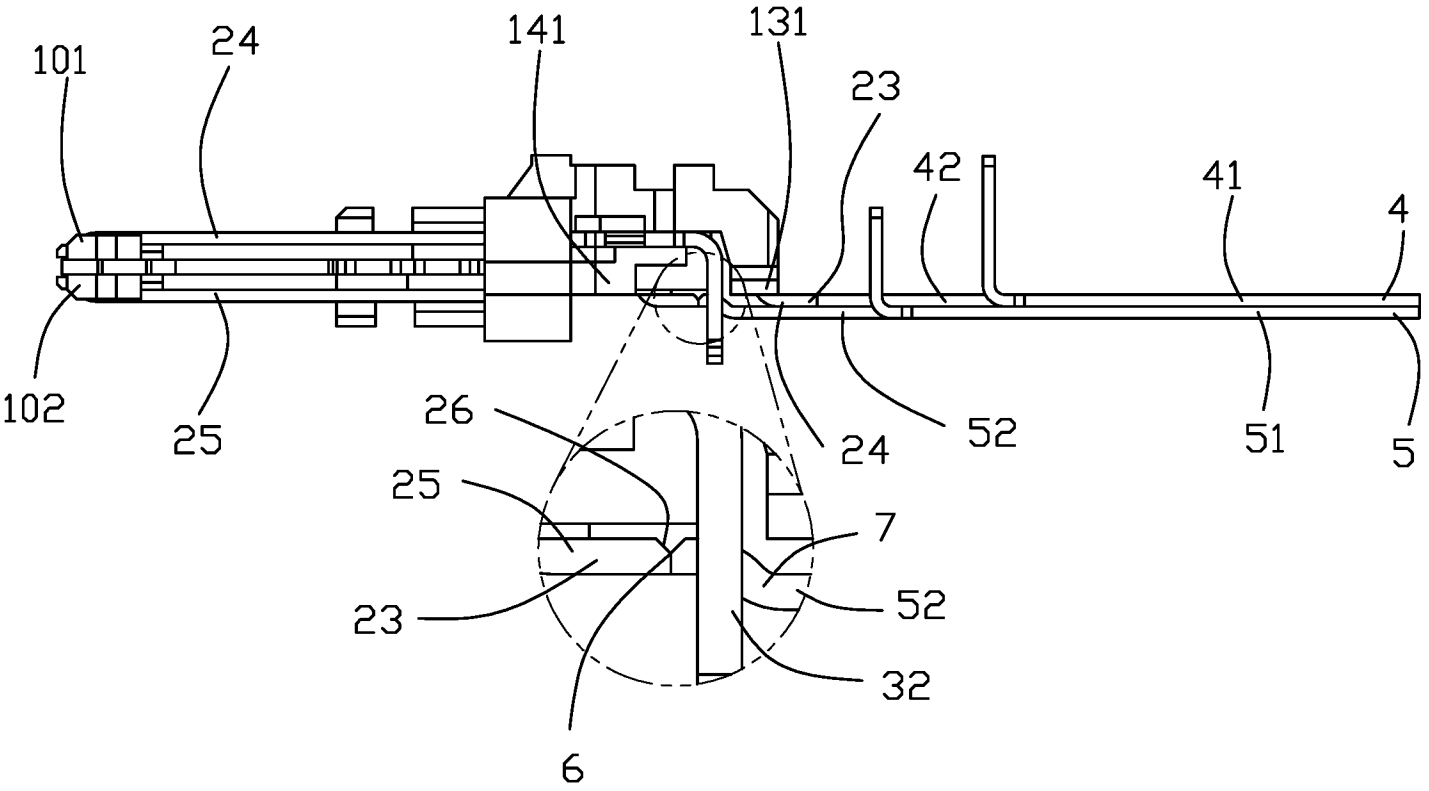
FIG. 11 is a side view of FIG. 9.
Figure 12:
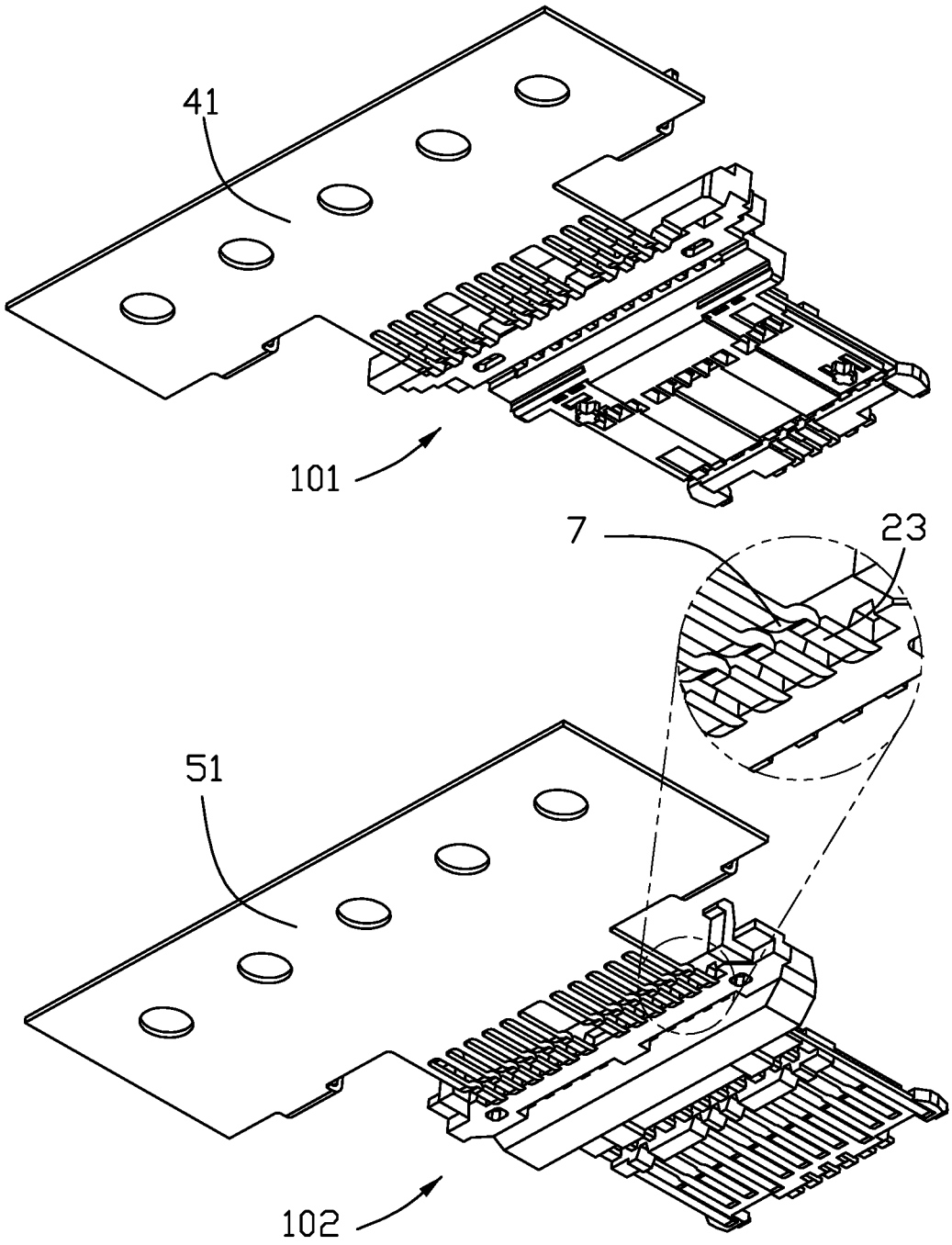
FIG. 12 is a perspective view of the upper contact module unit and the lower contact module unit of the electrical connector, with the associated carrier strips before over-molding.

Notably, as shown in FIGS. 6 and 7, in the instant invention, similar to the traditional connector, the lower contact module unit 102 is equipped with the retention posts 147 to be engaged within the corresponding retention holes 136 of the upper contact module unit 101, and further with a hooks 148 within the corresponding retention cavities 138 of the upper contact module unit 101; correspondingly the upper contact module unit 101 is equipped with the retention posts 137 to be engaged within the corresponding retention holes 146 of the lower contact module unit 102.

In brief, the instant invention is to use the stacked first/upper carrier strip and second/lower carrier strip as the holding mechanism for keeping the upper contact module unit and the lower contact module unit firmly together during over-molding wherein the lower carrier strip includes a bend to link to the corresponding soldering portion of each of the lower row of contacts for lowering the lower carrier strip from the upper carrier strip, and the soldering portion of each of the lower row of contacts is formed a V-shaped cut at a rear end linked to the corresponding connecting section of the lower carrier strip for easy severing the lower carrier strip therefrom.

What is claimed is:

1. A method of making an electrical connector which includes an insulative housing having a tongue with two opposite surfaces and a first and second rows of contacts with respective contacting portions exposed to opposite first and second surfaces of the tongue and respective soldering portions, characterized by the steps of:

forming the first row of contacts from a first contact carrier to have the soldering portions thereof connected to a first carrier strip;

forming the second row of contacts from a second contact carrier to have the soldering portions thereof connected to a second carrier strip;

insert-molding the first row of contacts with a first insulator to form a first contact module unit;

insert-molding the second row of contacts with a second insulator to form a second contact module unit;

holding the first carrier strip and the second carrier strip against each other; and over-molding a third insulator with the first contact module unit and the second contact module unit; wherein the soldering portions of the second row of contacts are located in front of the soldering portions of the first row of contacts in a front-to-back direction.

2. The method as claimed in claim 1, further comprising a step of bending the second carrier strip to break from the second row of contacts after the step of over-molding.

3. The method as claimed in claim 1, further comprising a step of forming a shielding plate, and wherein the step of holding comprises positioning the shielding plate between the first contact module unit and the second contact module unit and the step of over-molding comprises molding the third insulator with the first and second contact module units and the shielding plate.

4. The method as claimed in claim 1, wherein the soldering portions of the second row of contacts and the soldering portions of the first row of contacts are located at a same horizontal plane for common surface mounting.

5. The method as claimed in claim 1, wherein the first row of contacts and the second row of contacts have respective contacting portions respectively located upon the first surface and second surface of the tongue, and the first surface is higher than the second surface in a vertical direction perpendicular to the front-to-back direction.

6. The method as claimed in claim 1, wherein the soldering portions of the second row of contacts are connected to the second carrier strip via corresponding connecting sections, and a V-shaped cut is formed between each soldering portion and the corresponding connecting section.

7. The method as claimed in claim 6, wherein the soldering portion of the first row of contacts are exposed to an exterior in a vertical direction while the soldering portion of the second row of contacts are hidden under the housing in the vertical direction.

8. The method as claimed in claim 6, wherein a bend is formed between the soldering portion of each of the second row of contacts and the corresponding connecting section of the second carrier strip in a front-to-back direction.

9. The method as claimed in claim 8, wherein the soldering portions of the first row of contacts are linked to the first carrier strip via corresponding connecting sections, and no bend is formed between each soldering portion and the corresponding connecting section in the front-to-back direction.

10. The method as claimed in claim 6, wherein a rear end face of each soldering portion of the second row of contacts forms an inclined face due to said V-shaped cut.

11. The method as claimed in claim 10, wherein a rear end face of each soldering portion of the upper row of contacts is vertical.

12. A method of making an electrical connector which includes an insulative housing having a tongue with two opposite surfaces and a first and second rows of contacts with respective contacting portions exposed to opposite first and second surfaces of the tongue and respective soldering portions, characterized by the steps of:

forming the first row of contacts from a first contact carrier to have the soldering portions thereof connected to a first carrier strip;

forming the second row of contacts from a second contact carrier to have the soldering portions thereof connected to a second carrier strip;

insert-molding the first row of contacts with a first insulator to form a first contact module unit;

insert-molding the second row of contacts with a second insulator to form a second contact module unit;

holding the first carrier strip and the second carrier strip against each other; and over-molding a third insulator with the first contact module unit and the second contact module unit; wherein the soldering portions of the second row of contacts and the soldering portions of the first row of contacts are located at a same horizontal plane for common surface mounting; and the soldering portions of the second row of contacts are connected to the second carrier strip via corresponding connecting sections, and a V-shaped cut is formed between the soldering portion of each of the second row of contacts and an associated connecting section.

13. The method as claimed in claim 12, wherein the soldering portion of the first row of contacts are exposed to an exterior in a vertical direction while the soldering portion of the second row of contacts are hidden under the housing in the vertical direction.

14. The method as claimed in claim 12, wherein a bend is formed between the soldering portion of each of the second row of contacts and the corresponding connecting section of the second carrier strip in a front-to-back direction.

* * * * *